US005814946A

United States Patent [19]

Hall et al.

[11] Patent Number: 5,814,946

[45] Date of Patent: Sep. 29, 1998

[54] SEMICONDUCTOR JUNCTION BREAKDOWN TAP FOR A FIELD EMISSION DISPLAY

[75] Inventors: Garrett W. Hall; David A. Zimlich, both of Boise, Id.

[73] Assignee: Micron Display Technology, Inc., Boise, Id.

[21] Appl. No.: 752,831

[22] Filed: Nov. 20, 1996

[51] Int. Cl.[6] ..... G09G 3/12

[52] U.S. Cl. ..... 315/169.1; 345/74; 345/204

[58] Field of Search ..... 315/169.1, 169.2, 315/169.3; 345/74, 75, 204

[56] References Cited

U.S. PATENT DOCUMENTS

| | | | |
|---|---|---|---|
| 4,427,266 | 1/1984 | Hosokawa | 345/91 X |
| 5,404,081 | 4/1995 | Kane et al. | 315/169.1 |
| 5,519,414 | 5/1996 | Gold et al. | 345/208 |
| 5,537,007 | 7/1996 | Harberts et al. | 315/169.1 |
| 5,627,556 | 5/1997 | Kwon et al. | 345/76 |

*Primary Examiner*—Robert J. Pascal
*Assistant Examiner*—Justin P. Bettendorf
*Attorney, Agent, or Firm*—Seed and Berry LLP

[57] ABSTRACT

A field emission display includes a discrete storage capacitor coupled between a column line and a reference potential. The display also includes a discharge circuit coupled between a transmission line tap and the storage capacitor. The discharge circuit receives an image signal from the transmission line and transfers charge from the transmission line to the storage capacitor. In one embodiment, the discharge circuit includes a pair of opposed zener diodes. In response to a brief negative-going input pulse on the transmission line, the capacitor is discharged through the diodes. Then, the diodes recover and capacitor and column line are isolated from the tap. A selected line of an extraction grid is then activated to extract electrons from an emitter set coupled to the column line. The voltage differential between the extraction grid and the emitter set extracts electrons from the emitter set that are replaced by the capacitor. The capacitor has sufficient capacitance to supply electrons over an expected refresh interval of the column line. Therefore, the voltage of the capacitor remains substantially constant over the refresh interval. Because the capacitor can be charged quickly, the input pulse can be short relative to the refresh interval.

23 Claims, 4 Drawing Sheets

$V_P$
$V_{BU}+V_{FL}$
$V_{EM}$
$V_1$
$V_2$
$V_{INT}$
$V_3$
$V_{COL}$
$V_{CL}=V_P-V_{BU}-V_{FL}$
$V_{EM}$
$V_1-V_{BU}-V_{FL}$
$V_2-V_{BL}-V_{FU}$
$V_3-V_{BL}-V_{FU}$
$V_C$
$V_G$
$V_{ROW1}$
$V_G$
$V_{ROW2}$
$V_G$
$V_{ROW3}$
$t_1$ $t_2$ $t_3$ $t_4$ $t_5$ $t_6$ $t_7$ $t_8$ $t_9$ $t_{10}$ $t_{11}$ $t_{12}$ $t_{13}$ $t_{14}$ $t_{15}$

SEMICONDUCTOR JUNCTION BREAKDOWN TAP FOR A FIELD EMISSION DISPLAY

STATEMENT AS TO GOVERNMENT RIGHTS

This invention was made with government support under Contract No. DABT 63-93-C-0025 awarded by Advanced Research Projects Agency ("ARPA"). The government has certain rights in this invention.

TECHNICAL FIELD

The present invention relates to field emission displays, and more particularly, to driving circuits for field emission displays.

BACKGROUND OF THE INVENTION

Flat panel displays are widely used in a variety of applications, including computer displays. One suitable flat panel display is a field emission display. Field emission displays typically include a generally planar emitter substrate covered by a display screen. A surface of the emitter substrate has formed thereon an array of surface discontinuities or "emitters" projecting toward the display screen. In many cases, the emitters are conical projections integral to the substrate. Typically, contiguous groups of emitters are grouped into emitter sets in which the bases of emitters in each emitter set are commonly connected.

The emitter sets are typically arranged in an array of rows and columns, and a conductive extraction grid is positioned above each emitter. All, or a portion, of the extraction grid is driven with a voltage of about 30–120 V. Each emitter set is then selectively activated by applying a voltage to the emitter sets. The voltage differential between the extraction grid and the emitter set produces an electric field extending from the extraction grid to the emitter set having a sufficient intensity to cause the emitters to emit electrons.

The display screen is mounted directly above the extraction grid. The display screen is formed from a glass panel coated with a transparent conductive material that forms an anode biased to about 1–2 kV. The anode attracts the emitted electrons, causing the electrons to pass through the extraction grid. A cathodoluminescent layer covers a surface of the anode facing the extraction grid so that the electrons strike the cathodoluminescent layer as they travel toward the 1–2 kV potential of the anode. The electrons strike the cathodoluminescent layer, causing the cathodoluminescent layer to emit light at the impact site. Emitted light then passes through the anode and the glass panel where it is visible to a viewer. The light emitted from each of the areas thus becomes all or part of a picture element or "pixel."

The brightness of the light produced in response to the emitted electrons depends, in part, upon the rate at which electrons strike the cathodoluminescent layer. The light intensity of each pixel can thus be controlled by controlling the current available to the corresponding emitter set. To allow individual control of each of the pixels, the electric potential between each emitter set and the extraction grid is selectively controlled by a row signal and a column signal through corresponding drive circuitry. To create an image, the drive circuitry separately establishes current to each of the emitter sets.

In some embodiments, the voltage difference between an extraction grid and an emitter set is controlled by setting the entire extraction grid to a single voltage and selectively coupling each emitter set to a reference potential, such as ground. One drawback of such an approach is that the drive circuitry for each of the emitter sets must respond to both a column signal and a row signal. This approach typically requires separate transistors or other current control elements for each of the column signal and the row signal such that each pixel requires at least a pair of current control elements.

Another approach to controlling the voltage differential between each extraction grid and its associated emitter set is to divide the extraction grid into columns, with the extraction grids in each column being interconnected. Then, the array of emitter sets is divided into rows, with the emitter sets in each row being connected to each other and to a common row line.

To activate this display, one of the row lines is first grounded. Then, each of the column lines in the extraction grid is driven by a voltage corresponding to an image signal. To produce bright pixels, the column lines of the extraction grid are raised to a high voltage. To produce dim pixels, the column lines are held at a low voltage. The column lines are therefore driven by rapidly switching, high analog voltages that require relatively expensive driver circuitry.

Another approach to activating the display is to drive the sections of the extraction grid with a constant magnitude voltage in response to the row signal and to drive columns of the emitter substrate with analog voltages corresponding to the image signal. In this approach, the row lines of the extraction grid are selectively biased at a constant grid voltage $V_G$, one row at a time. During the time a row line of the extraction grid is biased, each column line of the emitter substrate receives an analog row voltage corresponding to an image signal. The emitter set in the column that intersects the biased row of the extraction grid will therefore emit light when the column line voltage is sufficiently below the voltage of the biased extraction grid row. The intensity of the emitted light will depend upon the voltage of the column line. If the column line voltage is very far below the grid voltage $V_G$, the pixel will be bright. If the column voltage is not very far below the grid voltage $V_G$, the pixel will be dim.

In this approach, the time during which each of the columns of the emitter substrate is active is only a small part of the time during which each row of the extraction grid is activated. Consequently, only a brief "window" is available to drive each of the column lines.

Because only a brief window is available, the column line must be pulled quickly down to the appropriate voltage. However, the electrical characteristics of the column line, such as its resistance and capacitance, can limit the speed at which the column line voltage can change. For example, the column line includes a distributed capacitance. Therefore, resistance between a signal input and the column line combines with the distributed capacitance to form an RC circuit whose time constant limits the speed at which a voltage applied to the column line can be coupled to the emitter sets in that column. Consequently, a brief input pulse at one end of the column line may not establish the emitter sets in the column line at the appropriate voltage. The duration of the input pulse is not easily increased, because the length of the pulse is limited by the window described above. The available pulse time can be lengthened somewhat by extending the refresh time of the pixels (i.e., the time between successive activations of an emitter set), because extending the refresh time increases the size of the window. However, this approach correspondingly reduces the rate at which an image can be "written," thereby impairing the operation of the display.

SUMMARY OF THE INVENTION

A matrix addressable display includes quickly chargeable storage circuits coupled to respective column lines.

Each storage circuit establishes the voltage of the row line, and thus the voltage of emitter sets coupled to the column line. Each emitter set positioned beneath is aligned to a respective row line of an extraction grid. One of the row lines is activated to a voltage of 30–120 V to produce an electric field extending between the row line and the emitter set. The electric field causes the emitter set to emit electrons. A transparent anode coats a glass panel opposite the extraction grid and is charged to a high voltage of 1–2 kV. The high anode voltage attracts the emitted electrons causing the emitted electrons to strike a cathodoluminescent layer covering the transparent anode. The emitted electrons cause the cathodoluminescent layer to emit light near the impact site. The emitted light passes through the transparent anode and glass panel where it is visible to an observer.

In one embodiment, the storage circuits are discrete capacitors. Each of the capacitors is coupled to a microstrip transmission line through a tap formed from a pair of opposed diodes having very rapid response times. A positive-going clearing pulse on the transmission line breaks down a first of the diodes, providing a high current to the capacitor. The current quickly clears the capacitor by raising the capacitor voltage $V_C$. Then, a negative-going image pulse breaks down the second diode to discharge the capacitor to an analog voltage $V_C$. When the pulse ends, the diodes block current flow between the transmission line and the capacitor.

As electrons are emitted from the emitter sets, they are replaced by electrons from the storage capacitor. In response to the loss of electrons, the capacitor voltage $V_C$ falls slightly. However, the current draw of the emitter sets is very low and the capacitance of the capacitor is sufficiently high such that the capacitor voltage $V_C$remains substantially constant over an expected refresh time of the display. Consequently, the emitter set continues to emit electrons at a substantially constant rate over an expected refresh time of the column line.

In a preferred embodiment of the invention, the transmission line is a microstrip line formed on a high dielectric substrate in a serpentine pattern. The taps are positioned at successive adjacent bends in the transmission line so that pulses arriving at the taps are separated in time. The transmission line is driven at one end by an image signal $V_{IM}$ formed from several variable amplitude pulses corresponding to a desired image. The opposite end of the transmission line receives a control pulse $V_{CP}$ having a positive portion and a negative portion. The positive portion clears the capacitor and the negative portion constructively interferes with the image signal $V_{IM}$ to provide the charging voltage for the capacitor at each of the taps.

DETAILED DESCRIPTION OF THE INVENTION

Figure 1:
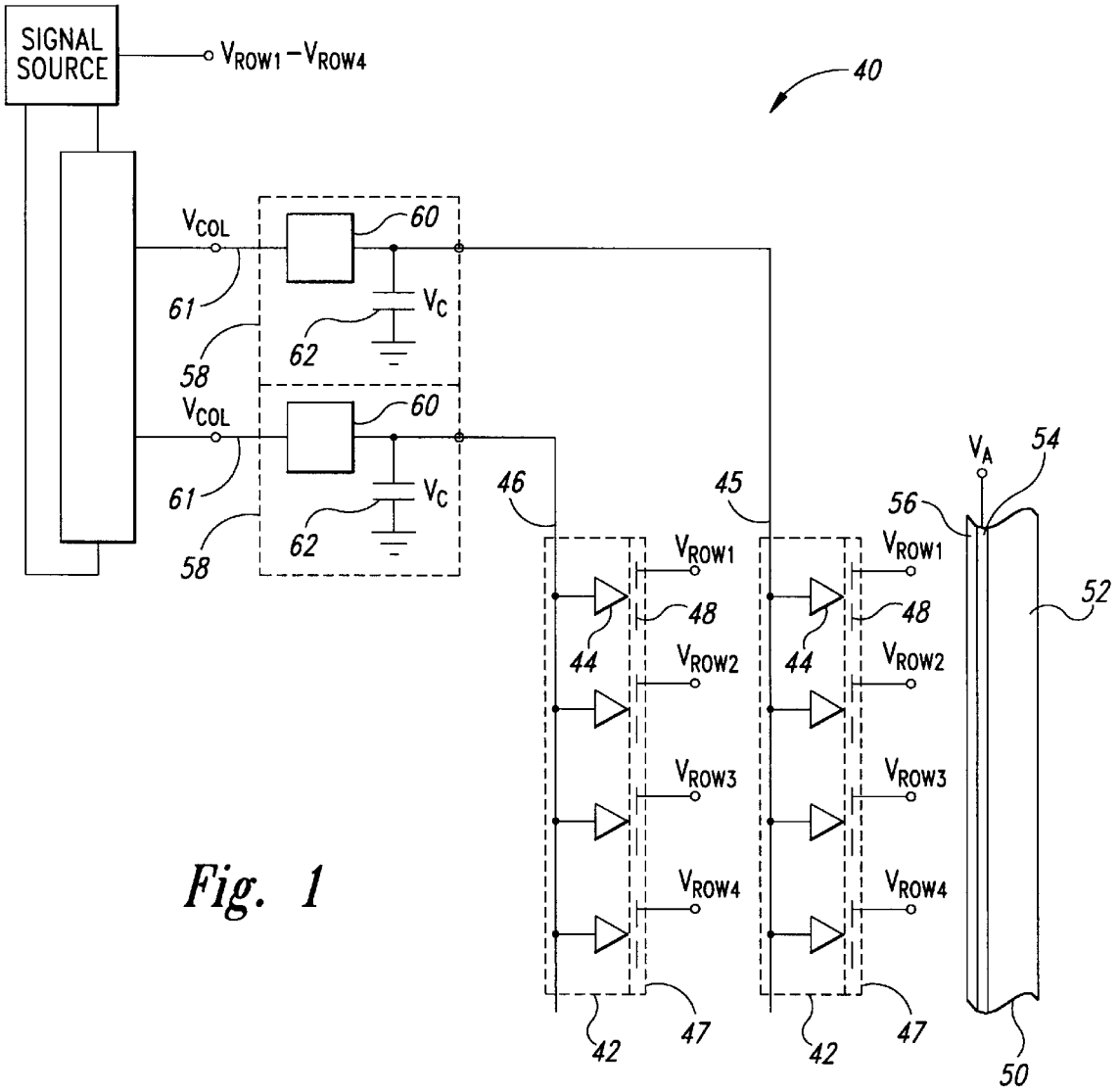
FIG. 1 is a diagrammatic representation of a portion of a field emission display according to the invention including current control circuits coupled to column lines.

As shown in FIG. 1, a field emission display 40 includes an emitter substrate 42 having four emitter sets 44 coupled to a first column line 45 and four more emitter sets 44 coupled to a second column line 46. Although the emitter substrate 42 of FIG. 1 is represented with only two columns of four emitter sets 44 for clarity of presentation, one skilled in the art will recognize that such emitter substrates 42 typically include an array containing many columns with each column having several emitter sets. Also, although the emitter sets 44 are each represented by a single conical emitter, one skilled in the art will recognize that such emitter sets 44 typically include several emitters that are commonly connected. Moreover, although the preferred embodiment of the display 40 employs emitter sets 44, other light emitting assemblies, such as liquid crystal elements, may also be within the scope of the invention.

A conductive extraction grid 47 is positioned above the emitter substrate 42. The extraction grid 47 is formed by several row lines 48 that are parallel conductive strips. Each row line 48 intersects one column of emitter sets 44 on the emitter substrate 42. For example, the first row line 48 intersects the first emitter set 44 in both the first and second columns. A screen 50 is positioned opposite the emitter substrate 42 and spaced apart from the extraction grid 47. The screen 50 includes a glass panel 52 having a transparent conductive anode 54 on its lower surface. A cathodoluminescent layer 56 coats the transparent conductive anode between the anode 54 and the extraction grid 47.

In operation, selected ones of the row lines 48 are biased at a grid voltage $V_G$ of about 30–120 V and the anode 54 is biased at a high voltage $V_A$ such as 1–2 kV. If an emitter set 44 is connected to a voltage much lower than the grid voltage $V_G$, such as ground, the voltage difference between the row line 48 and the emitter set 44 produces an intense electric field between the row line 48 and emitter set 44. The electric field causes the emitter set 44 to emit electrons according to the Fowler-Nordheim equation. The emitted electrons are attracted by the high anode voltage $V_A$ and travel toward the anode 54 where they strike the cathodoluminescent layer 56, causing the cathodoluminescent layer 56 to emit light around the impact site. The emitted light passes through the transparent anode 54 and the transparent panel 52 where it is visible to an observer.

The intensity of light emitted by the cathodoluminescent layer 56 depends upon the rate at which electrons emitted by the emitter sets 44 strike the cathodoluminescent layer 56. The rate at which the emitter sets 44 emit electrons is controlled, in turn, by current control circuits 58 coupled to the respective column lines 45. Each current control circuit 58 includes a discharge circuit 60 coupled between the respective column input 61 and column line 45. Each current control circuit 58 also includes a storage capacitor 62 coupled between the column line 45 and ground. The discharge circuit 60 receives the column signal $V_{COL}$ and provides a column line voltage to the capacitor 62 and column line 45.

Figure 2:
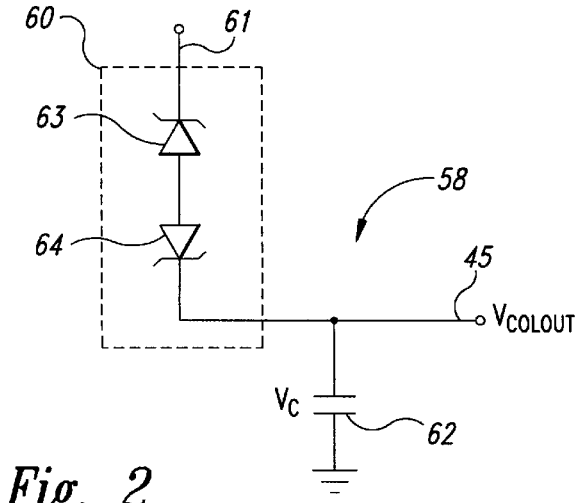
FIG. 2 is a schematic of a portion of one of the current control circuits of FIG. 1 showing a pair of opposed zener diodes coupled to charge a storage capacitor.

FIG. 2 presents one embodiment of the current control circuit 58 where the discharge circuit 60 is formed from a pair of opposed diodes 63, 64 coupled between the column input 61 and the column line 45. The diodes 63, 64 are zener diodes having well-defined breakdown voltages $V_B$ and forward bias voltages $V_F$ and rapid recovery times.

Figures 3A, 3B, 3C, 3D, 3E:
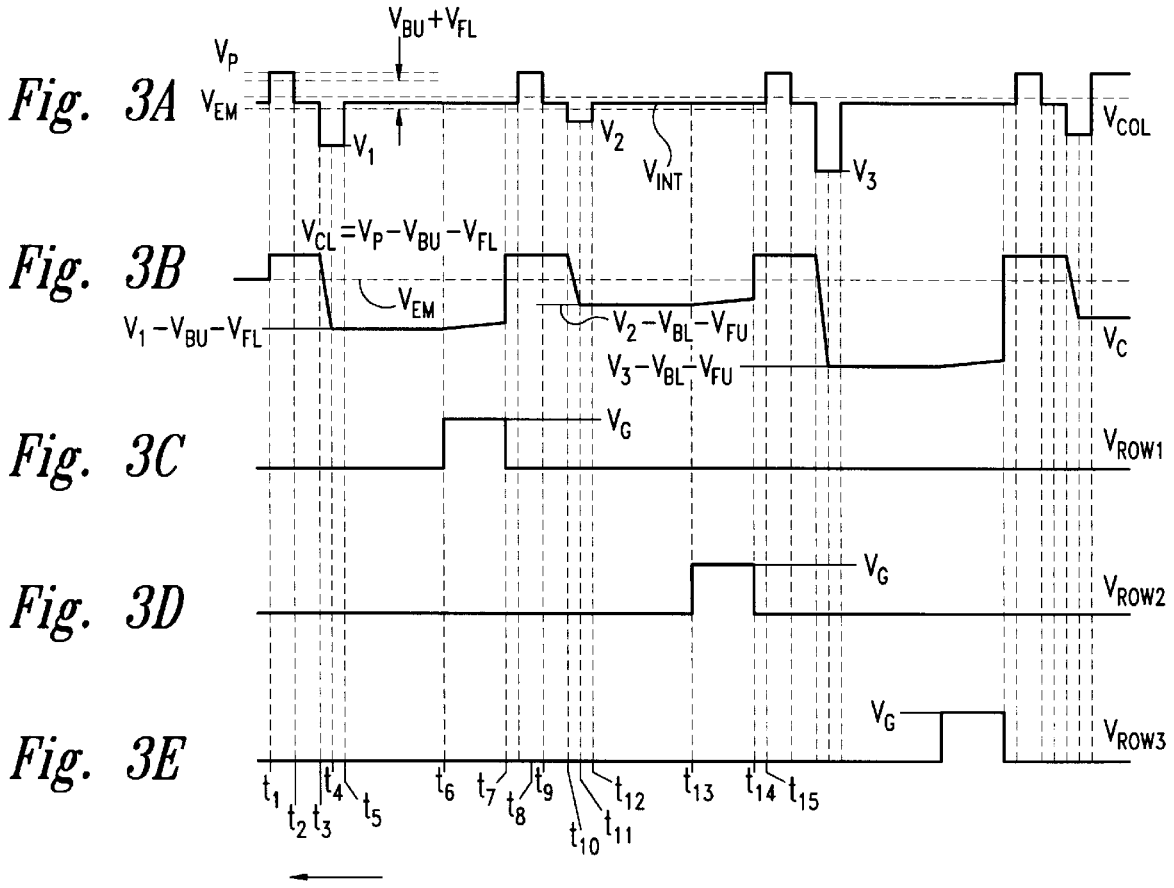
FIG. 3A is a signal timing diagram showing variable amplitude column voltage pulses having a positive-going portion and a negative-going portion.
FIG. 3B is a signal timing diagram showing capacitor voltages in response to the column voltages of FIG. 3A.
FIG. 3C is a signal timing diagram showing a fixed amplitude row voltage for a first row of the display.
FIG. 3D is a signal timing diagram showing a fixed amplitude row voltage for a second row of the display.
FIG. 3E is a signal timing diagram showing a fixed amplitude row voltage for a third row of the display.

Operation of the display 40 is best explained in conjunction with the signal timing diagrams of FIGS. 3A–3E. As shown in FIG. 3A, the column signal $V_{COL}$ is a series of signal pulses each having a positive-going portion followed, after a brief delay, by a negative-going portion, where negative and positive are referenced to an emission voltage $V_{EM}$. The positive-going portions have uniform amplitudes and the negative-going portions have variable amplitudes. The emission voltage $V_{EM}$ is the voltage below which the emitter sets 44 begin to emit electrons in response to a biased column line 48.

First, at a time $t_1$, the positive-going portion of the first signal pulse having a magnitude $V_P$ arrives at the upper diode 63. The magnitude $V_P$ is greater than the capacitor voltage $V_C$ plus the breakdown voltage $V_{BU}$ of the upper diode 63 and the forward bias voltage $V_{FL}$ of the lower diode 64 so that both diodes 63, 64 become conductive. The positive-going portion quickly charges the capacitor 62 to a cleared voltage $V_{CL}$ equal to the voltage of the positive-going portion less the breakdown voltage $V_{BU}$ of the upper diode 63 and the forward bias voltage $V_{FL}$ of the lower diode 64 (FIG. 3B). The cleared voltage $V_{CL}$ is greater than the maximum emission voltage $V_{EM}$ of the emitter sets 44. Therefore, the emitter sets 44 coupled to the capacitor 62 will not emit electrons. The positive going portion thus clears the capacitor 62 so that the emitter sets 44 will not emit electrons.

At time $t_2$, the column voltage $V_{COL}$ returns to an intermediate voltage $V_{INT}$ which is between the magnitude $V_P$ of the positive-going portion and the capacitor voltage $V_C$. The voltage difference between the column voltage $V_{COL}$ and the capacitor voltage $V_C$ causes the diodes 63, 64 to become non-conductive so that current does not flow into the capacitor 62.

Next, the negative-going portion of the signal pulse arrives at a time $t_3$ with a voltage $V_1$, as referenced below the emitter voltage $V_{EM}$. In response to the negative-going portion, the difference between the capacitor voltage $V_C$ and the voltage $V_1$ is greater than the breakdown voltage $V_{BL}$ of the lower diode 64 and the forward bias voltage $V_{FU}$ of the upper diode 63. As a result, the lower diode 64 breaks down and the upper diode 63 becomes forward biased so that both diodes 63, 64 become conductive. As shown in FIG. 3B, the capacitor 62 discharges quickly until a time $t_4$ at which the voltage $V_C$ on the capacitor is equal to the voltage $V_1$ minus the sum of the forward bias voltage $V_{FU}$ of the upper diode 63 and the breakdown voltage $V_{BL}$ of the lower diode 64.

The column voltage $V_{COL}$ returns to the intermediate voltage $V_{INT}$ at time $t_5$ and the diodes 63, 64 once again form open circuits, causing the capacitor voltage $V_C$ to remain at the voltage $V_1$, minus the sum of the upper diode breakdown voltage $V_{BU}$ and the forward bias voltage $V_{FL}$. Since the first emitter set 44 is connected to the capacitor 62, the capacitor voltage $V_C$ is applied to the emitter set 44. The voltage differential between the first row line 48 and the first emitter set 44 is insufficient to extract electrons. The capacitor voltage $V_C$ thus remains constant while subsequent columns of the array are activated.

After all of the capacitor voltages $V_C$ are established, the row voltage $V_{ROW1}$ on a first of the row lines 48 (FIG. 1) goes high at time $t_6$, to a voltage of approximately 30–120 V. The emitter sets 44 at this point are at the capacitor voltage $V_C$, because the emitter sets 44 are electrically connected to the capacitor 62 through the column line 45. The voltage differential between the first row line 48 and the first emitter set 44 causes the first emitter set 44 to emit electrons. The remaining emitter sets 44 on the column line 45 are unaffected, because only the first row line 48 is at a high voltage. As described above, the emitted electrons are drawn toward the screen 50 by the anode 54 where they strike the cathodoluminescent layer 56 and produce light at the impact site.

As the first emitter set 44 emits electrons, the emitted electrons are replaced by electrons drawn from the capacitor 62. As can be seen in FIG. 3B, the capacitor voltage $V_C$ rises slightly as the electrons flow from the capacitor 62 to the first emitter set 44. However, the capacitor 62 is sufficiently large and the current through the emitter set 44 is sufficiently small that the capacitor voltage $V_C$ remains at a substantially constant level over the entire time that the first row line 48 is high.

As can be seen from FIG. 3B, the time during which the capacitor 62 provides electrons to the emitter set 44 is substantially longer than the time during which electrons are stored on the capacitor 62 by the negative-going portion of the signal. The time to charge the capacitor can be less than 1 or 2% of the overall refresh time. For example, for a typical refresh interval (i.e., the time that the row signal is high plus the time for establishing the capacitor voltages) of about 35 $\mu$s, the signal pulse is about 0.02 $\mu$s for a 640 column color display or 0.055 $\mu$s for a monochrome display. Consequently, the width of the signal pulse can be very short while still providing a large number of electrons to the emitter set 44 over a substantial period of time. This allows the emitter set 44 to produce a bright pixel without requiring a long signal pulse.

Without the capacitor 62, it would be difficult to provide an adequate number of electrons to the emitter set 44, because of the electrical characteristics of the column line 45. Electrically, the column line 45 can be modeled as a distributed resistive and capacitive load with additional resistance between the capacitor 62 and the first emitter set 44.

The distributed capacitance of the column line 45 can store charge in a similar fashion to the discrete capacitor 62. However, the rate at which the voltage of the column line can be pulled down is limited by the resistive nature of the column line 45, especially the resistance between the capacitor 62 and the first emitter set 44. Thus, a short pulse would not pull down the voltage of the column line to a sufficiently low voltage unless an impractically large voltage is applied. Further, the rate at which charge is stored is limited by the resistive nature of the column line 45, especially the resistance between the capacitor 62 and the first emitter set 44. The overall charge transfer to the distributed capacitance during a short signal pulse is thus limited. Consequently, the time to store adequate charge could be excessive if the capacitor 62 were removed. These effects can be overcome partially by increasing the magnitude of the input pulse voltage to increase the amount of charge stored by the column line capacitance. However, increased pulse voltage comes at the cost of more expensive column drivers. Moreover, high voltages may damage the emitter substrate 42.

The addition of the capacitor 62 thus allows a substantial amount of charge to be injected more quickly than a capacitor-less approach. The reduced charge transfer time reduces the required signal pulse width and thus allows the emitter substrate 42 to be driven more quickly for a given brightness level.

Returning to the timing diagrams of FIGS. 3A–3E, the voltage of the first column line $V_{ROW1}$ returns low at a time $t_7$, and the first emitter set 44 stops emitting electrons, because the voltage difference between the first row line 48 and the first emitter set 44 is less than the emission voltage $V_{EM}$. Accordingly, the capacitor 62 stops supplying electrons to the first emitter set 44. Shortly thereafter, at a time $t_8$, a second signal pulse arrives (FIG. 3A). The positive-going portion of the signal pulse charges the capacitor 62 to the cleared voltage $V_{CL}$. Then, the positive-going portion ends at a time $t_9$, returning to the intermediate voltage $V_{INT}$. The second emitter set 44 does not emit electrons, because the row voltage $V_{ROW2}$ is still low.

Then, at time $t_{10}$, the negative-going portion of the second signal pulse arrives with a new voltage $V_2$. The capacitor voltage $V_C$ drops quickly toward the pulse voltage $V_2$ minus the sum of the breakdown voltage $V_{BU}$ of the upper diode 63 and the forward bias voltage $V_{FL}$ of the lower diode 64 (FIG. 3B). A short time later at time $t_{11}$, the negative-going portion of the pulse ends and the column voltage $V_{COL}$ returns to the intermediate voltage $V_{INT}$. The diodes 63, 64 block current from flowing between the column input 61 and the capacitor 62. Thus, the capacitor voltage $V_C$ stays at the voltage $V_2$ minus the sum of the breakdown voltage $V_{BU}$ of the upper diode 63 and the forward bias voltage $V_{FL}$ of the lower diode 64, while the capacitors in all of the remaining columns are charged.

At time $t_{13}$, after all of the column lines 45 are activated, the row voltage $V_{ROW2}$ on the second row line 48 goes high (FIG. 3D). The resulting voltage differential between the second column line 48 and the second emitter set 44 causes the second emitter set 44 to emit electrons. The emitted electrons strike the cathodoluminescent layer 56 in the region above the second emitter set 44, producing light in a second location.

As the electrons are emitted, the capacitor 62 replaces the emitted electrons, causing the capacitor voltage $V_C$ to increase slightly. However, the low current draw of the emitter set 44 and high storage capacity of the capacitor 62 allow the capacitor voltage $V_C$ to remain substantially constant until a time $t_{14}$, when the row voltage $V_{ROW2}$ returns low.

Next, a new signal pulse arrives at time $t_{15}$ and the above-described steps are then repeated for the new signal pulse and subsequent signal pulses to activate the remaining emitter sets 44 coupled to the column line 45. Meanwhile, similar activation of other column lines 45 in the display 40 is ongoing, so that every emitter set 44 in the display 40 is driven according to the image signal $V_{IM}$.

While the above description presents activation of a single column line 45 within the emitter substrate 42, one skilled in the art will understand that each of the remaining columns of the display 40 include respective capacitors 62. Each of these capacitors 62 is charged by respective pulses during the interval between subsequent pulses of the column signal $V_{COL}$ on the column line 45 to supply charge to their corresponding emitter sets 44.

Figure 4:
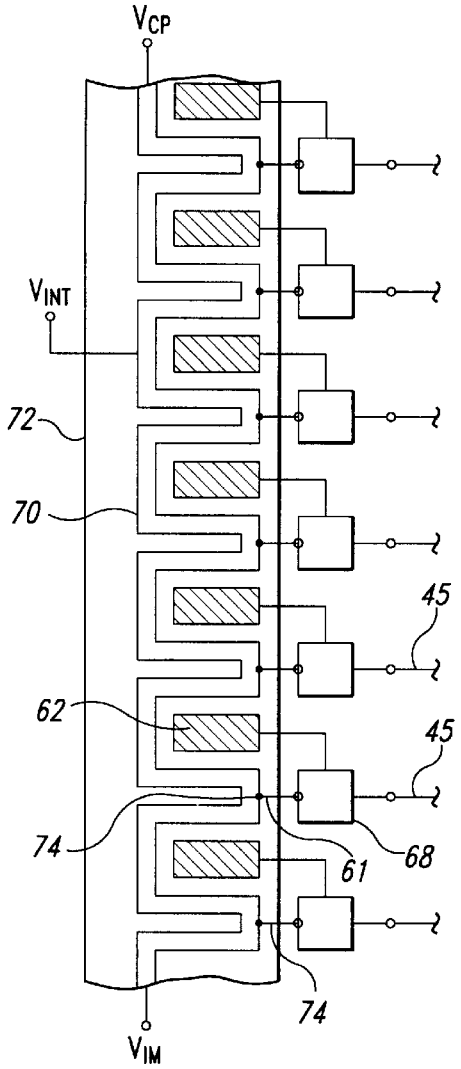
FIG. 4 is a partial schematic, partial top plan view of a microstrip delay line and the storage capacitor formed on a common substrate and coupled to drive adjacent column lines of the display of FIG. 1.

FIG. 4 presents one structure for producing and supplying the signal pulses of FIG. 3A that also incorporates the capacitor 62. As shown in FIG. 4 a transmission line 70 is formed on a high dielectric substrate 72 in a serpentine pattern. The transmission line 70 is preferably a microstrip, although other transmission line structures, such as strip lines, may also be within the scope of the invention. Several equally spaced taps 74 along the transmission line 70 are coupled to the column inputs 61 of respective current control circuits 58 to provide the column signal $V_{COL}$ described above with respect to FIG. 3A.

Figure 5A:
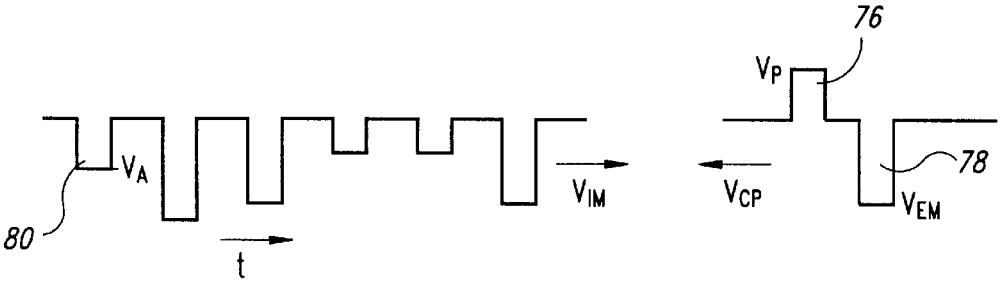
FIG. 5A is a signal timing diagram showing pulses traveling in opposite directions on the microstrip line of FIG. 4.

Generation of the signal pulses of FIG. 3A is best described with reference to FIGS. 4, 5A–5B. As seen in FIG. 4 the transmission line 70 receives the image signal $V_{IM}$ at its left end and a control pulse $V_{CP}$ at its right end. As shown in FIG. 5A, the image signal $V_{IM}$ is a pulse train having equally spaced, variable amplitude, negative-going pulses. As will be explained below, the amplitude of each pulse of the image signal $V_{IM}$ represents the brightness of a respective pixel in a column. The control pulse $V_{CP}$ is input to the right end of the transmission line 70 and includes a positive portion 76 followed by a negative portion 78 having a magnitude equal to the emission voltage $V_{EM}$. The positive portion of the control pulse $V_{CP}$ is delayed relative to the negative portion to ease timing control constraints along the transmission line 70 and to allow time for the row lines 48 (FIG. 1) to go high after clearing, as described above.

As the control pulse $V_{CP}$ travels from right to left along the transmission line 70, the control pulse $V_{CP}$ intercepts each successive pulse of the image signal $V_{IM}$. The relative timing of the image signal $V_{IM}$ and the control pulse $V_{CP}$ are carefully controlled such that the negative portion 78 of the control pulse $V_{CP}$ intercepts each successive pulse of the image signal $V_{IM}$ at successive ones of the taps 74. The control pulse $V_{CP}$ constructively interferes with each pulse of the image signal $V_{IM}$ to produce a respective composite signal at each of the taps 74. The composite signal for the leftmost tap 74 is shown in FIG. 5B.

Figure 5B:
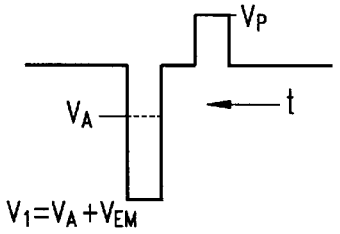
FIG. 5B is a diagram of voltage at a tap due to constructive interference of the pulses traveling in opposite directions in the microstrip line of FIG. 4 with the time axis inverted.

Working from right to left in FIG. 5B (according to the direction of travel of the control pulse $V_{CP}$), the positive portion 76 of the control pulse is the first signal to arrive at the leftmost tap 74. The positive portion 76 quickly raises the tap voltage to the pulse voltage $V_P$. When the positive portion 76 passes the tap 74, the tap voltage drops.

Immediately afterwards, the negative portion 78 of the control pulse $V_{CP}$ arrives at the tap 74. Simultaneously, the last pulse 80 of the image signal $V_{IM}$ arrives at the tap 74 with a voltage $V_A$. The last pulse 80 and the negative portion 78 constructively interfere to produce a tap voltage $V_1$ having a negative-going magnitude that is the sum of the magnitudes of the last pulse 80 and the negative portion 78. When the last pulse 80 and negative portion 78 leave the tap 74, the tap voltage returns to the intermediate voltage $V_{INT}$. Taking into account the reversal of the time axis in FIG. 5B, the tap voltage of FIG. 5B is a composite signal identical to the signal pulse of FIG. 3A. One skilled in the art will recognize that each of the taps 74 receives a similar composite signal if each successive pulse of the image signal $V_{IM}$ is timed to intercept the control pulse $V_{CP}$ at each successive tap 74. For example, the second-to-last pulse of the image signal $V_{IM}$ arrives at the second tap 74 from the left simultaneously with the negative portion 78 of the control pulse $V_{CP}$. Similarly, the first pulse of the image signal $V_{IM}$ arrives at the rightmost tap 74 simultaneously with the negative portion 78 of the control pulse $V_{CP}$. The constructively interfered pulses therefore provide the composite signals described above with respect to FIG. 3A to each of the current control circuits 58.

The separation between pulses at subsequent taps 74 is determined by the distance between successive taps 74 and the propagation velocity of pulses along the transmission line 70. To slow propagation of the control pulse $V_{CP}$ and the image signal $V_{IM}$ along the microstrip, the dielectric constant of the substrate 72 is very high. The slowed propagation of the signals $V_{IM}$, $V_{CP}$ facilitates timing of the arrivals of pulses at the successive taps 74 by increasing the time between arrival of successive pulses of the image signal $V_{IM}$ at each tap 74 without requiring an excessively long transmission line 70.

The present invention takes advantage of the high dielectric constant and the substantial surface area between adjacent turns of the serpentine transmission line 70 by forming one plate of the capacitor 62 directly on the upper surface of the substrate 72, as shown in FIG. 4. The lower surface of the substrate 72, which is the ground plane of the microstrip transmission line 70, forms the second plate of the capacitor 62.

Thus, the substrate 72 carries both the transmission line 70 and the capacitors 62, eliminating the need for discrete capacitors elsewhere in the display 40. The capacitors 62 thereby utilize the "dead" space between adjacent turns of the transmission line 70. Also, both the transmission line 70 and the capacitor 62 can be fabricated using compatible, conventional techniques, easing fabrication of the structure.

The high dielectric constant of the substrate and the large available area between successive turns of the transmission line allow the capacitor 62 to be fabricated with a relatively high capacitance, on the order of 1000 pF. The actual value of the discrete capacitor 62 may vary greatly depending upon the electrical properties of the display 40, such as the current draw of the emitter sets 44, the resistive component of the column line 45, and any additional resistance between the discharge circuit 60 and the capacitor 62. However, the capacitance of the discrete capacitor 62 is preferably greater than ⅕ of the distributed capacitance of column line 45. As the distributed capacitance of the column line 45 decreases and as the current draw of the emitter sets 44 increase, the capacitance of the capacitor 62 can be correspondingly increased by changing the dimensions of the capacitor 62 or the dielectric constant of the substrate 72. If necessary the capacitance of the capacitor 62 may even exceed the distributed capacitance of the column line 45. The high capacitance allows the capacitor 62 to store sufficient charge that the electron draw of the emitter set 44 does not substantially change the capacitor voltage $V_C$ over the expected refresh interval of the column line 45.

Figure 6A:
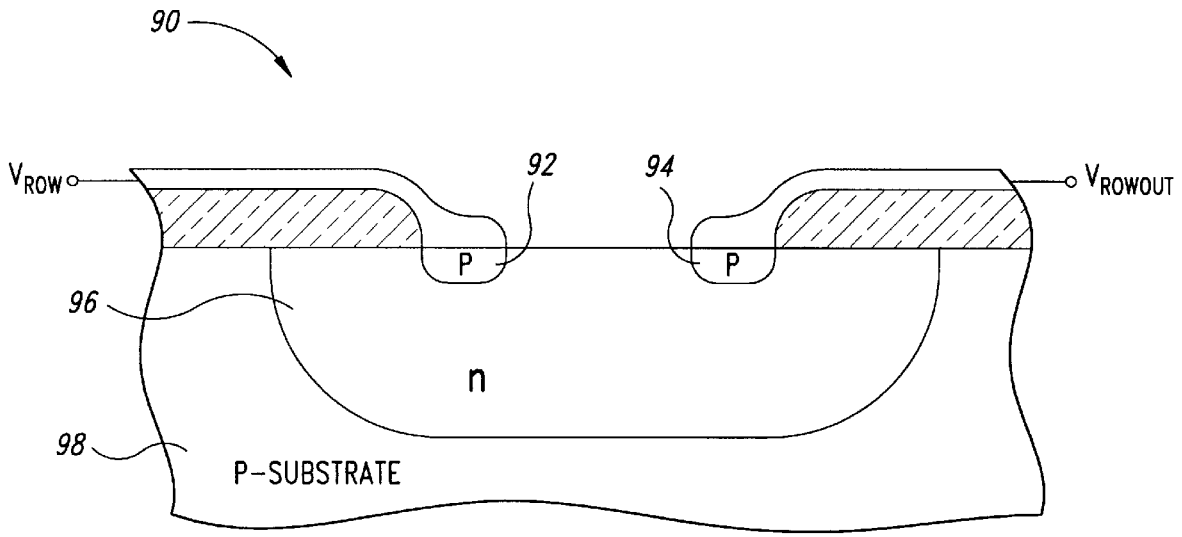
FIG. 6A is a cross-sectional detailed view of a discharge circuit for use in the current control circuit of FIG. 2.
Figure 6B:
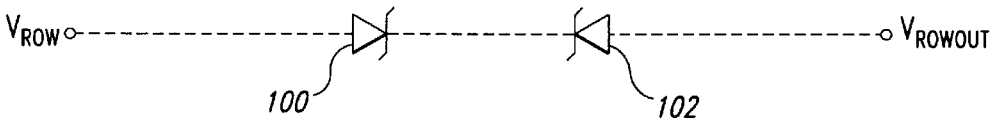
FIG. 6B is a schematic representation of opposed effective diodes representing the electrical characteristics of the semiconductor device of FIG. 6A.

While the preferred embodiment employs discrete opposed diodes 63, 64, the discharge circuit 60 may alternatively be realized as a single integrated component. For example, as shown in FIG. 6A, a single integrated semiconductor device 90 can replace the diodes 63, 64. The semiconductor device 90 includes a pair of p regions 94 and an n-well 96 formed in a p-type substrate 98. The interfaces between the p regions 92, 94 and the n-well 96 form a pair of opposed pn junctions that act as effective diodes 100, 102 as indicated in FIG. 6B. The doping levels and profiles of the p regions 92, 94 and the n-well 96 are selected to produce the appropriate electrical characteristics (i.e., well-defined breakdown voltages $V_B$, well-defined forward bias voltages $V_F$ and rapid recovery time), according to conventional semiconductor techniques.

Comparing the diodes 63, 64 of FIG. 2 to the effective diodes 100, 102 of FIG. 6B, it can be seen that the opposed diodes 63, 64 or 100, 102 can be connected anode-to-anode or cathode-to-cathode. Thus, the positions of the upper and lower diodes 63, 64 of FIG. 2 can be reversed. Similarly, a mirror-image of the semiconductor device 90 can be produced using a pair of n regions in a p-well.

One skilled in the art will recognize several variations on the timing of the signals $V_{CP}$, $V_{IM}$ that are within the scope of the invention. For example, U.S. Pat. No. 5,519,414 to Gold et al. and assigned to OWL Displays, Inc., which is incorporated herein by reference, describes several variations of constructively interfering pulses along tapped transmission lines for driving matrix displays. Additionally, the circuit structures described herein can be applied to selectively drive the extraction grid 47, although the polarities of the signals would be reversed.

While the present invention has been described by way of an exemplary embodiment, various modifications to the embodiment described herein can be made without departing from the scope of the invention. Accordingly, the present invention is not limited except as by the appended claims.

We claim:

1. A transmission line tap for a field emission displays the line tap coupled to a transmission line for tapping a portion of an input signal exceeding a threshold voltage and blocking a portion of the input signal less than the threshold voltage, comprising:

first and second opposed semiconductor junctions coupled between a transmission line and an output terminal, wherein the first junction is coupled to block current from flowing in a first direction and the second junction is coupled to block current from flowing in a second direction opposite the first direction, the second junction having a forward bias voltage, the first junction having a breakdown voltage substantially equal to the threshold voltage less the forward bias voltage of the second junction, the second junction having a breakdown voltage selected to correspond to a magnitude of a clearing pulse carried on a transmission line.

2. The tap of claim 1 wherein the first and second junctions are integrated into a common substrate.

3. The tap of claim 1, further comprising a storage capacitor coupled between the output terminal and a reference potential.

4. The tap of claim 1 wherein the first and second junctions form zener diodes.

5. A transmission line tap for driving a signal line in a field emission display, the signal line having a line capacitance, the tap providing an output signal in response to pulses having voltages greater than a threshold voltage, wherein the pulses have a pulse duration, the tap comprising:

first and second opposed p-n junctions coupled between the transmission line and the line capacitance wherein the first p-n junction has a breakdown voltage selected to correspond to the threshold voltage and the second p-n junction has a breakdown voltage selected to correspond to a voltage of a clearing pulse, the first p-n junction having a response time sufficiently short to charge the line capacitance during the pulse duration.

6. The tap of claim 5, further comprising a supplemental capacitance coupled between the signal line and a reference potential, wherein the response time of the first p-n junction is sufficiently short to substantially charge the line capacitance and the supplemental capacitance within the pulse duration.

7. The tap of claim 5 wherein the first p-n junction comprises a doping profile selected such that the first p-n junction is a zener junction.

8. The tap of claim 5 wherein the first and second p-n junctions are integrated into a common substrate.

9. The tap of claim 8 wherein the first and second p-n junctions comprise a common n-region.

10. The tap of claim 8 wherein the first and second p-n junctions comprise a common p-region.

11. A field emission display for displaying an image in response to an input signal, from a signal source wherein the input signal includes a portion exceeding a threshold voltage, comprising:

a transmission line coupled to the signal source and carrying a clearing pulse having a magnitude;

a transmission line tap having an input coupled to the transmission line and an output, the tap further including first and second opposed semiconductor junctions coupled between a transmission line and an output terminal, wherein the first junction is coupled to block current from flowing in a first direction and the second junction is coupled to block current from flowing in a second direction opposite the first direction, the second junction having a forward bias voltage, the first junction having a breakdown voltage substantially equal to the threshold voltage less the forward bias voltage of the second junction, the second junction having a breakdown voltage selected to correspond to the magnitude of the clearing pulse; and a field emission display assembly coupled to the output terminal.

12. The display of claim 11, further comprising a storage capacitor coupled between the output terminal and a reference potential.

13. The display of claim 11 wherein the first and second junctions form zener diodes.

14. The display of claim 11 wherein the first and second junctions are integrated into a common substrate.

15. A field emission display apparatus for producing an image, comprising:

a signal source producing a series of pulses, wherein selected pulses include a portion exceeding a threshold voltage, each pulse having a pulse duration;

a transmission line coupled to the signal source, the transmission line carrying a clearing pulse having a magnitude;

a plurality of transmission line taps spaced along the transmission line, each tap including first and second opposed p-n junctions coupled between the transmission line wherein the first p-n junction has a breakdown voltage selected to correspond to the threshold voltage and the second p-n junction has a breakdown voltage selected to correspond to the magnitude of the clearing pulse; and a signal line coupled to one of the taps, the signal line having a line capacitance;

wherein the first p-n junction has a response time sufficiently short to charge the line capacitance during the pulse duration.

16. The apparatus of claim 15 wherein the tap further includes a supplemental capacitance coupled between the signal line and a reference potential and wherein the response time of the first p-n junction is sufficiently short to substantially charge the line capacitance and the supplemental capacitance within the pulse duration.

17. The tap of claim 15 wherein the first p-n junction comprises a doping profile selected such that the first p-n junction is a zener junction.

18. The tap of claim 15 wherein the first and second p-n junctions are integrated into a common substrate.

19. The tap of claim 18 wherein the first and second p-n junctions comprise a common n-region.

20. A method of driving a signal line in a field emission display in response to an image signal, comprising the steps of:

producing a transmission line pulse in response to the image signal;

breaking down a reverse biased diode with the transmission line pulse to produce an output signal;

storing charge in response to the output signal;

discharging the stored charge into the signal line, and blocking discharge of the stored charge into the transmission line with a second diode.

21. The method of claims 20, further comprising the step of clearing the stored charge with a clearing pulse.

22. The method of claim 21 wherein the step of clearing the stored charge with a clearing pulse comprises the step of breaking down the second diode.

23. The method of claim 20 wherein the step of producing a transmission line pulse comprises the step of constructively interfering first and second signals on a transmission line.

* * * * *